United States Patent [19]

Yamaji et al.

[11] Patent Number: 4,494,905

[45] Date of Patent: Jan. 22, 1985

[54] APPARATUS FOR STOPPING TRUCK AT PRESELECTED POSITION

[75] Inventors: Hiromasa Yamaji; Yuji Kobayashi, both of Yokosuka, Japan

[73] Assignee: Sumitomo Heavy Industries, Ltd., Tokyo, Japan

[21] Appl. No.: 386,318

[22] Filed: Jun. 8, 1982

[30] Foreign Application Priority Data

Jun. 10, 1981 [JP] Japan ..... 56-89078

[51] Int. Cl.[3] ..... B65G 69/00

[52] U.S. Cl. ..... 414/584; 104/1 R; 188/38.5; 202/262; 202/270

[58] Field of Search ..... 104/1 R, 16, 17 R, 249; 414/163, 215, 401, 584; 188/2 R, 38, 38.5, 43; 202/239, 262, 270

[56] References Cited

U.S. PATENT DOCUMENTS

| | | | |
|---|---|---|---|
| 1,245,530 | 11/1917 | Thomas | 188/38.5 |
| 1,896,883 | 2/1933 | Callison | 414/584 X |
| 3,754,512 | 8/1973 | Kmety | 104/249 |
| 3,810,500 | 5/1974 | Brun et al. | 414/401 X |
| 3,877,549 | 4/1975 | Clark, Jr. | 188/38 |
| 4,068,593 | 1/1978 | Leeves | 104/17 A X |
| 4,248,562 | 2/1981 | Tsuzuki et al. | 414/401 X |
| 4,435,250 | 3/1984 | Lindgren | 104/1 R X |

FOREIGN PATENT DOCUMENTS

| | | | |
|---|---|---|---|
| 48-27882 | 8/1973 | Japan . | |
| 655489 | 4/1979 | U.S.S.R. | 104/93 |

*Primary Examiner*—Randolph Reese

*Attorney, Agent, or Firm*—Armstrong, Nikaido, Marmelstein & Kubovcik

[57] ABSTRACT

An apparatus for stopping a truck such as a larry car for coke oven operation at a preselected position in relation to an object such as a coke oven. The apparatus includes stopping members such as blocks placed along the path of movement of the truck and a clamping mechanism carried by the truck and adapted to cooperate with one of the blocks to locate and stop the truck. The clamping mechanism includes a pair of levers swingable about axes perpendicular to the longitudinal axis of the truck by the operation of a fluid-operated cylinder and adapted to clamp the selected block from the front and rear sides of the block. In operation, the truck is temporarily stopped by a brake at such a position that the selected block is positioned between two levers and then the levers are swung toward each other to clamp the block therebetween to locate and stop the truck precisely at the designated position. During the running of the truck, the levers are laterally swung to clear the blocks.

4 Claims, 8 Drawing Figures

APPARATUS FOR STOPPING TRUCK AT PRESELECTED POSITION

BACKGROUND OF THE INVENTION

The present invention relates to an apparatus for stopping a truck precisely at a preselected position. In the coke oven operations, various trucks are made to run along rails laid along a battery of coke ovens. These trucks are, for example, larry cars for charging coal into the coke oven, pusher machine for pushing hot coke from the coke oven, coke guide truck, extinguisher truck and so forth. In the safe and efficient coke oven operations, it is necessary to precisely stop the truck at a preselected position in relation to a particular coke oven of the battery for the proper functioning of such trucks, e.g. charging of coal, discharging of coke and so forth.

If the stopping of the truck has to be made solely through the manual braking operation by an operator, such an operator is required to be highly trained and skilled and, even if he is highly trained and skilled, it is quite difficult to stop the truck at once precisely at the preselected position. Namely, it is necessary to repeat a minute readjustment of the position or inching, taking much labor and time. In order to obviate the above-described problem, it has been proposed and attempted to automatically stop the truck by a cooperation of an electric position detecting means and a truck driving/-stopping means operative in response to the signal from the position detecting means. This attempt, however, requires a repetition of correcting operation in order to attain a sufficiently high precision of stopping, so that a longer time is required as the demand for precision becomes more severe. In addition, the undesirable phenomenon called hunting takes place to make the system practically unusable if the precision or gain is increased beyond a predetermined critical value.

Under this circumstance, Japanese Patent Publication No. 27882/73 discloses a stopping apparatus having blocks for limiting the position of stopping of the truck and laid on the floor between two rails and a pair of clamping members attached to the lower part of the truck and adapted to be operated by a pair of cylinders, respectively, to clamp one of the blocks thereby to forcibly stop the truck at the preselected position. This apparatus is advantageous in that its operation is simple and completed in quite a short period of time, but requires a complicated mechanism for retracting the clamping members to clear the blocks during running of the truck. Furthermore, a complicated electric circuit is required for the adjustment of strokes of both clamping members.

SUMMARY OF THE INVENTION

Accordingly, an object of the invention is to provide an apparatus for stopping a truck at a preselected position, having a simplified construction and capable of stopping the truck promptly and precisely.

To this end, according to the invention, there is provided an apparatus for stopping a truck at a preselected position comprising a clamping mechanism supported by the truck or by a stationary structure arranged along the path of movement of the truck; and at least one stopping member fixed to the stationary structure or the truck and adapted to be clamped by the clamping mechanism, wherein the clamping mechanism includes: a frame rotatable about an axis extending in the direction of running of the truck; driving means for rotating the frame within a predetermined angular range; a pair of levers pivotally secured at their central portions to the frame so as to be swingable about two respective axes which are perpendicular to the axis of rotation of the frame and spaced from each other in the direction of axis of rotation of the frame; a fluid-operated cylinder having a piston rod and a cylinder body pivotally connected to the one ends of the levers, respectively, the fluid-operated cylinder being operative to swing the levers such that the other ends of the levers being movable towards and away from each other; and a stopper fixed to the frame and adapted to limit the closing positions of the levers.

The above and other objects, features and advantages of the invention will become clear from the following description of the preferred embodiments taken in conjunction with the accompanying drawings.

DESCRIPTION OF THE PREFERRED EMBODIMENTS

Figure 1:
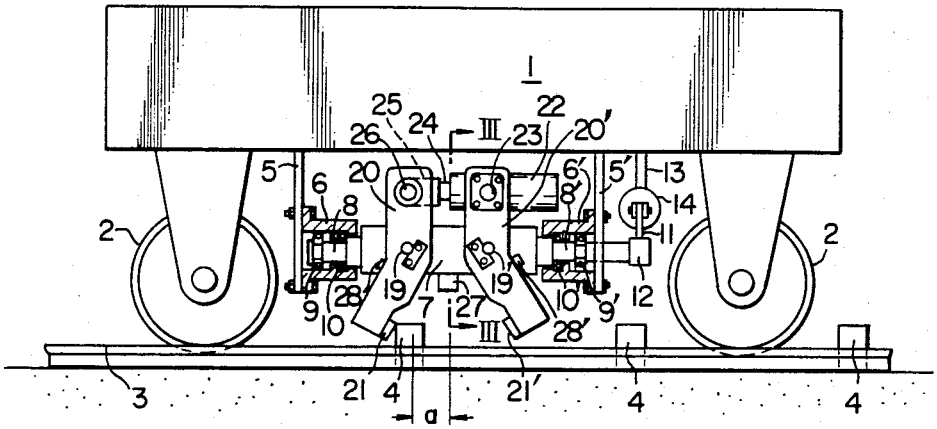
FIG. 1 is a schematic front elevational view of an apparatus for stopping a truck at a preselected position in accordance with an embodiment of the invention, in the state just before the commencement of stopping operation.
Figure 2:
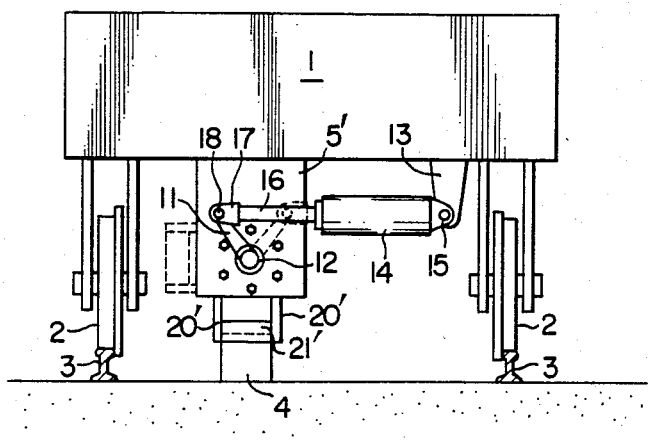
FIG. 2 is a side elevational view of the apparatus shown in FIG. 1.
Figure 3:
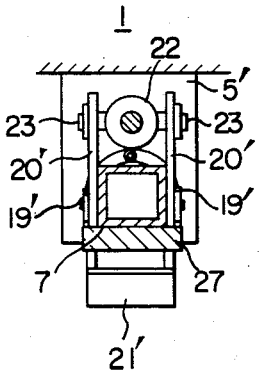
FIG. 3 is a sectional view taken along the line III—III of FIG. 1.

In FIGS. 1 and 2 showing a schematic front elevational view and a side elevational view of an embodiment of the invention, a reference numeral 1 denotes a truck for coke oven operations, such as a larry car for charging coal into coke oven, pusher machine for pushing hot coke from the coke oven, coke guide truck, extinguisher truck and so forth, adapted to run along a pair of rails 3 by means of wheels 2. A plurality of stopping blocks 4 as stopping members for limiting the positions at which the truck 1 is to be stopped are fixedly provided on the floor surface between parallel rails 3. More specifically, one stopping block 4 is provided for each one of a battery of coke ovens. A left bracket 5 and a right bracket 5' constituting a pair are suspended from the lower part of the truck 1. Bearing boxes 6, 6' are fixed to the lower ends of the brackets 5, 5'. A frame 7 (See FIG. 3) having a rectangular cross-section carries shafts 8, 8' fixed to both ends thereof. These shafts 8, 8' are supported by radial ball bearings 9, 9' and thrust ball bearings 10, 10' in the bearing boxes 6, 6'. The right-side shaft 8' extends beyond the bracket 5'. To the end of the shaft 8' is fixed a boss 12 of an arm 11. At the right side of the bracket 5', a hydraulic or pneumatic cylinder 14 pivoted by a pin 15 at its rear end to the lower end of a bracket 13 suspended from the lower side of the truck 1. The cylinder 14 has a piston rod 16 to the free end of which is attached a yoke 17 which in turn is pivoted by a pin 18 to the free end of the arm 11. Pairs of studs 19, 19' spaced in the longitudinal direction of the frame 7 are projected from both lateral side portions of the frame 7. Levers 20 and 20' are swingably supported by these studs 19, 19'. The levers 20 and 20' at each side of the truck are shaped such that in their inoperative positions as shown in FIG. 1, their upper halves are substantially in parallel with each other and their lower halves are diverging towards the lower ends. The paired levers 20, 20 of the left side, opposing to each other across the frame, are united to each other through an abutting plate 21 welded to their lower ends. Similarly, the paired levers 20', 20' of the right side are united to each other through an abutting plate 21' welded to the lower ends thereof. The levers 20', 20' are pivotally secured at their upper ends to the studs 23 projecting from both sides of the cylinder body of a hydraulic or pneumatic cylinder 22, while the upper ends of the levers 20, 20 are pivotally secured by a pin 26 to a fork end 25 attached to the free end of a piston rod 24 of the cylinder 22. A laterally extending stopper 27 having a rectangular cross-section is fixed to the center of the lower surface of the frame 7 for limiting the closing position of the levers 20, 20'. Second stoppers 28, 28' for limiting the opening positions of the levers 20, 20' are secured to both lateral sides of the frame 7.

Figure 4:
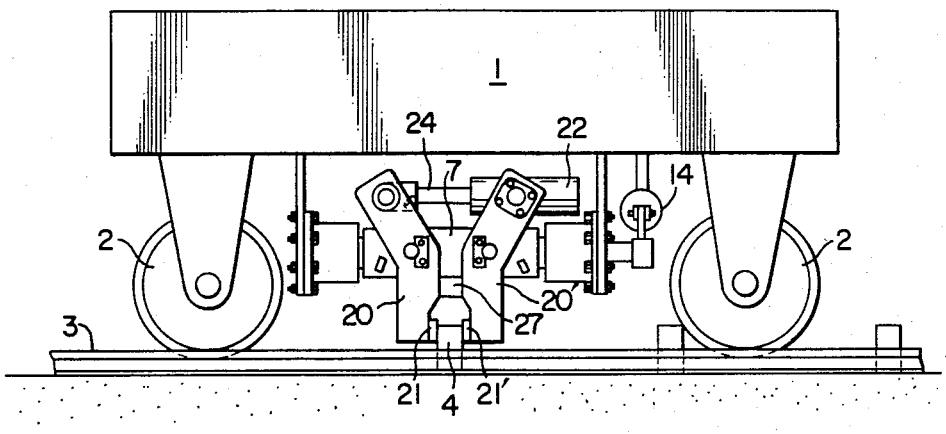
FIG. 4 is a front elevational view of the apparatus shown in FIG. 1, in the state after completion of the stopping operation.

In operation, during running of the truck, the cylinder 22 retracts its piston rod 24 is as shown in FIG. 1 so that the left and right levers 20, 20' are swung away from each other to the maximum opening, i.e. into contact with respective stoppers 28, 28'. In this state, the piston rod 16 of the cylinder 14 is retracted as indicated by broken line in FIG. 2 to swing the frame 7 90° clockwise to keep the levers 20, 20' in horizontal posture so that the abutting plates 21, 21' may clear the block 4 during running. The operator puts a brake into effect when the truck 1 has been moved sufficiently close to the position to be stopped to brake and stop the truck 1 temporarily. Then, the cylinder 14 extends its piston rod 16 to swing the frame 7 counter-clockwise thereby to bring the levers 20, 20' to the positions shown by full line in FIG. 2. It is necessary that this temporary stopping be made at such a position that the designated block 4 is positioned at least between the abutting plates 21, 21' of the levers 20, 20' opened to the maximum opening degree, as shown in FIG. 1. Namely, it is essential that the truck 1 be stopped within the range of maximum allowable error a of stopping position which is given as the distance between the neutral line of the block 4 and the neutral line of the stopper 27 in the state in which one 21 of the abutting plates abuts the designated block 4. Then, the cylinder 22 is operated to extend the piston rod 24 thereby to swing the levers 20, 20' in the closing direction so that the abutting plate welded to either one pair of the levers 20 and 20' abuts the block 4 as shown in FIG. 1. Then, as the cylinder 22 continue to extend the piston rod 24, the other pair of the levers 20, 20' comes into contact with the stopper 27. Then, the abutting plate brought for the first time into contact with the block 4, i.e. the abutting plate 21 in the state as shown in FIG. 1, pushes the block 4 to produce a reactional force which acts to move the truck 1 in such a direction as to reduce the error or deviation from the correct stopping position where the neutral axis of the block 4 and the neutral axis of the stopper 27 coincides with each other. Finally, both abutting plates 21, 21' clamp the block 4 as shown in FIG. 4, so that the truck 1 is located and stopped precisely at the designated position when the levers 20, 20' abut the stopper 27. As stated before, the stopper 27 is necessary for limiting the closing positions of the levers 20, 20' thereby to always ensure that the truck 1 is precisely stopped at the predetermined position. The truck 1 can be stationed fixedly at this position by making the abutting plates 21, 21' continue to clamp the block 4 or by putting the brake into effect while unclamping the block 4. The stopping apparatus of the invention can be operated without any specific skill to promptly locate and stop the truck 1, because, once the truck 1 is stopped roughly within the range of maximum allowable error of ±a, the fine adjustment of the position is made by a simple mechanical action to locate and stop the truck precisely at the designated position.

In the embodiment described hereinbefore, the clamping mechanism consisting of the frame 7, levers 20, 20' and cylinders 14 and 22 and so on is mounted on the truck 1 while the block 4 for cooperating with the clamping mechanism is secured to the ground. This, however, is not exclusive and an equivalent effect is obtained by arranging such that the block 4 is mounted on the truck 1 while the clamping mechanism is stationed on the ground. In the latter case, the weight of the truck 1 can be reduced advantageously because the truck 1 does not carry the clamping mechanism. This arrangement, however, is suited for the case where the number of stopping positions is small, because it is necessary to employ the clamping mechanism corresponding in number to the stopping positions. Even when the number of stopping positions is large, the latter arrangement can equally be carried out provided that the pitch of the stopping positions is small as compared with the length of the truck because, in such a case, it is possible to omit some of the stationary clamping mechanisms by providing the truck 1 with a plurality of blocks.

Figure 7:
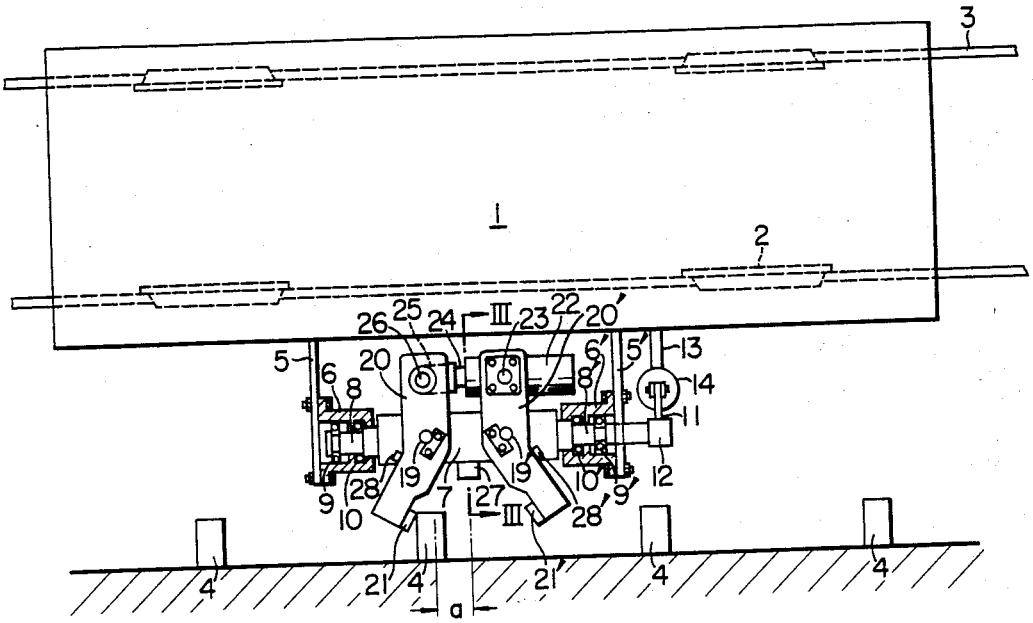
FIG. 7 is a plan view of a further embodiment of the invention.
Figure 8:
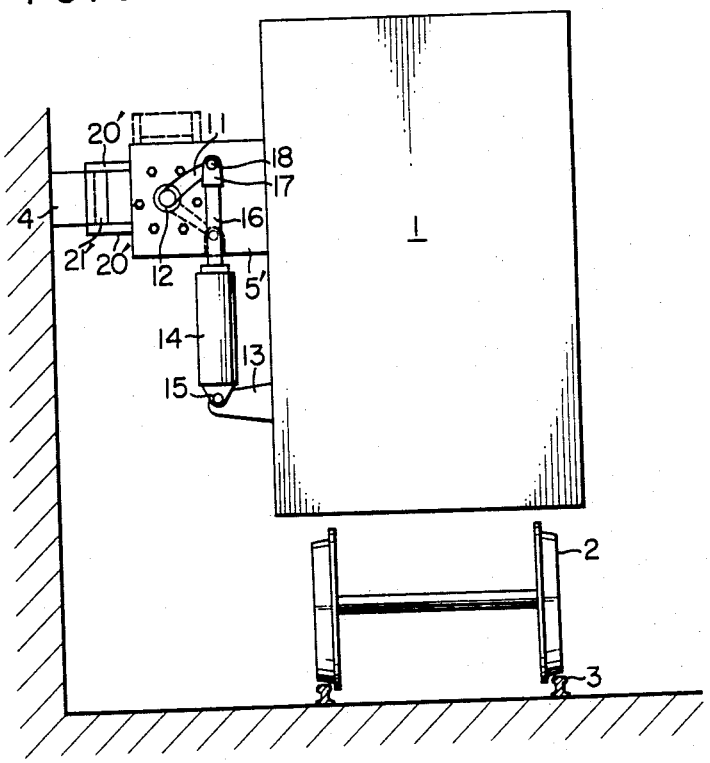
FIG. 8 is a side elevational view of the embodiment shown in FIG. 7.

It is also possible to arrange such that the clamping mechanisms are provided to project laterally from the truck 1 to cooperate with blocks 4 which are projected laterally from a stationary structure disposed along the side of the rails instead of being installed on the floor between the rails as shown in FIGS. 7 and 8 in which the same parts shown in FIGS. 1 to 4 are identified by the same reference numerals. In this case, the back stays provided at partitions between the coke ovens can be utilized effectively as the bases for mounting the blocks.

Figure 5:
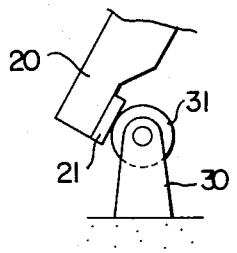
FIG. 5 is a schematic illustration of another embodiment in which the stopping member is constituted by a roller.

FIG. 5 shows another embodiment in which a roller 31 supported by a bracket 30 is used as the stopping member in place of the block used in the foregoing embodiment. In the embodiment described in connection with FIGS. 1 to 4, the abutting plate 21 is liable to be damaged due to collision with the corner of the block 4. This problem, however, is overcome and the wear of the abutting plate is diminished owing to the use of the roller as the stopping member as shown in FIG. 5.

Figure 6:
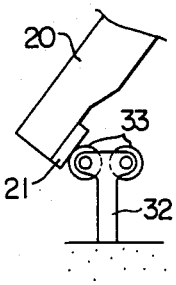
FIG. 6 is a schematic illustration of still another embodiment in which the stopping member is constituted by a pair of rollers.

FIG. 6 shows still another embodiment in which a bracket 32 carries a pair of rollers 33. This embodiment is suitable for use in the case where there is a substantial distance between the levers 20 and 20'.

As has been described, according to the invention, it is possible to promptly and precisely locate and stop a truck at the preselected position. The stopping apparatus of the invention, therefore, has a wide application and high utility not only for the trucks for coke oven operations but also for other types of apparatus necessitating similar locating and stopping function, such as operation of a crane or the like.

What is claimed is:

1. An apparatus for stopping a truck for use in coke oven operations at a preselected position comprising a clamping mechanism supported by said truck and at least one stopping member stationarily disposed along the path of movement of said truck and adapted to be clamped by said clamping mechanism, wherein said clamping mechanism comprises:

a frame rotatable about an axis extending in the direction of running of said truck;

driving means for rotating said frame within a predetermined angular range;

a pair of levers pivotally secured at their central portions to said frame so as to be swingable about two respective axes which are perpendicular to the axis of rotation of said frame and spaced from each other in the direction of the axis of rotation of said frame;

a fluid-operated cylinder having a piston rod and a cylinder body each being connected to a respective end of one of said levers, said fluid-operated cylinder being operative to swing said levers in such a manner that the other ends of said levers move towards each other to engage said stopping member whereby said truck is moved forward or backward to said preselected position; and a stopper fixed to the frame between said levers and adapted to limit the closing positions of said levers.

2. An apparatus for stopping a truck for use in coke oven operations at a preselected position according to claim 1, wherein said clamping mechanism is suspended from the lower side of the truck and said stopping member is positioned to protrude from the floor under said truck.

3. An apparatus for stopping a truck for use in coke oven operations at a preselected position according to claim 1, wherein said clamping mechanism is supported on said truck to project said levers laterally and said stopping member is laterally projected from a stationary structure located along the lateral side of the path of movement of said truck.

4. An apparatus for stopping a truck for use in coke oven operations at a preselected position according to any one of claims 1 to 3, wherein said stopping member is a block.

* * * * *